US006978210B1

(12) United States Patent
Suter et al.

(10) Patent No.: US 6,978,210 B1
(45) Date of Patent: Dec. 20, 2005

(54) METHOD FOR AUTOMATED MANAGEMENT OF HYDROCARBON GATHERING SYSTEMS

(75) Inventors: James R. Suter, Houston, TX (US); Russell L. Borgman, Houston, TX (US); Joe L. Corrales, Katy, TX (US); John K. Sammons, Katy, TX (US); Marvin R. Hensley, Freer, TX (US); Edward J. Brasset, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 645 days.

(21) Appl. No.: 09/697,788

(22) Filed: Oct. 26, 2000

(51) Int. Cl.[7] ..... G01V 9/00
(52) U.S. Cl. ..... 702/13; 702/6
(58) Field of Search ..... 702/13, 6, 12, 702/11

(56) References Cited

U.S. PATENT DOCUMENTS 5,635,652 A * 6/1997 Beaudin ..... 73/863.03
6,002,985 A * 12/1999 Stephenson ..... 702/13
6,101,447 A * 8/2000 Poe, Jr. ..... 702/13
6,128,579 A * 10/2000 McCormack et al. ..... 702/13
6,266,619 B1 * 7/2001 Thomas et al. ..... 702/13
6,318,156 B1 * 11/2001 Dutton et al. ..... 73/61.44
6,446,014 B1 * 9/2002 Ocondi ..... 702/45
6,446,721 B2 * 9/2002 Patel et al. ..... 166/252.1
6,456,902 B1 * 9/2002 Streetman ..... 700/282
6,549,879 B1 * 4/2003 Cullick et al. ..... 703/10
6,739,394 B2 * 5/2004 Vinegar et al. ..... 166/245
2003/0196788 A1 * 10/2003 Vinegar et al. ..... 166/57

OTHER PUBLICATIONS

Printout from website: www.livelink.com; AlintaGas Case Study: "Using Livelink to Make Business Systems More Efficient," Copyright 2001, Open Text Corporation, 2 pages.
Printout from website: www.livelink.com; TransCanada Pipelines Ltd. Case Study: "Livelink Delivers Faster Regulatory Fillings and Cost Savings," Copyright 2001, Open Text Corporation, 2 pages.
Printout from website: www.livelink.com; Livelink Modules: "Information Retrieval Modules," Copyright 2001, Open Text Corporation, 2 pages.

(Continued)

*Primary Examiner*—Marc S. Hoff
*Assistant Examiner*—Anthony Gutierrez
(74) *Attorney, Agent, or Firm*—Madan, Mossman & Sriram P.C.

(57) ABSTRACT

The invention is a method for automated management of hydrocarbon gathering systems. Measurement data is automatically collected from automated measurement and control devices that are located in a hydrocarbon production system The data that is collected is compared with data stored in a database. The comparison of data is used to automatically schedule tests of the plurality of automated measurement and control devices. The invention also automatically collects well test data, system balance data, and hydrocarbon composition data and uses the collected data to manage the hydrocarbon production and delivery process. The invention also automatically generates periodic grid reports concerning the status of the gathering system.

26 Claims, 10 Drawing Sheets

OTHER PUBLICATIONS

Printout from website: www.livelink.com; Livelink Modules: "Livelink eLink," Copyright 2001, Open Text Corporation, 2 pages.

Printout from website: www.livelink.com; Livelink Modules: "Livelink Activator for BASIS," Copyright 2001, Open Text Corporation, 2 pages.

Printout from website: www.livelink.com; Livelink Modules: "Livelink Records Management," Copyright 2001, Open Text Corporation, 2 pages.

Printout from website: www.livelink.com; Livelink Modules: "Livelink Activator for CORBA Development Kit," Copyright 2001, Open Text Corporation, 2 pages.

* cited by examiner

METHOD FOR AUTOMATED MANAGEMENT OF HYDROCARBON GATHERING SYSTEMS

BACKGROUND OF THE INVENTION

An oil and gas company which sells petroleum products typically deals with many producers and customers and uses diverse assets (such as wells, processing facilities, and pipelines) in wide-spread geographical locations. For example, many steps are involved in the production, gathering, processing, and sale of natural gas and its derivative products. An integrated natural gas company may have its own exploration and production operations. The integrated natural gas company may also deal with a number of independent producers, each with different contractual terms concerning the purchase and production of natural gas.

FIG. 1 shows a typical hydrocarbon gathering system 10. Producing wells 12 may be owned and operated by the gathering company or by third party producers. These wells 12 are connected by gathering lines 14 that gather produced gas and transport the gas to, for example, gas processing plants 16. At each well 12, natural gas measurement equipment 18 is installed to measure the pressure and volume of natural gas that is produced. Measurement of the flow volume and natural gas composition at each well is important because the natural gas gatherer must know both the quantity and composition of natural gas that has been produced and that is being transported in the gathering system 10.

Natural gas that has been gathered from producing wells 12 is typically transported to a gas processing plant 16 via gathering lines 14. If the gathering line 14 is of a low pressure type, there may be a compression station 20 integrally located with the gathering line 14 to compress the natural gas. At the gas processing plant 16, the gas is treated to produce pipeline quality natural gas and marketable natural gas liquid (NGL) derivatives. The gas is finally sent to a pipeline 22 where it may be distributed to customers, third parties, or storage facilities. NGLs are typically transported to storage tanks 24 where they may be delivered 26 to customers via truck. However, if sufficiently large quantities of NGLs are produced by a gas processing plant 16, the NGLs may be delivered directly to customers via a pipeline.

Natural gas, when produced from the earth, may have a widely varying composition depending on the field, the formation, or the reservoir from which it is produced. The principal constituents of natural gas are methane and ethane, but most gases contain varying amounts of higher carbon content components, such as propane, butanes, and other hydrocarbons. Natural gas may also contain water, hydrogen sulfide, carbon dioxide, nitrogen, helium, or other components that may be dilutents and/or contaminants. Natural gas is typically processed into two parts: a light gas component and a heavier gas-derivative liquid (e.g., natural gas liquid, or NGL) component.

The separation of the two parts is typically performed in gas processing plants (GPP) with either absorption or cryogenic processes. The light gas component typically comprises mostly methane, while the liquid derivatives typically comprise the remaining ethane, propane, butane, isobutane, and natural gasoline, among other liquids. These natural gas liquids (NGLs) are separated from the light gas component because NGLs have separate commercial value and to make the natural gas component merchantable.

Natural gas gathering companies must closely monitor all aspects of natural gas production, gathering, processing, and delivery. Many monitoring functions are now performed with electronic devices, such as electronic flow meters (EFMs), remote terminal units (RTUs), and programmable logic controller (PLCs). For example, EFMs monitor pressure and flow volume at each well and at inlets and outlets of compression stations and gas processing plants. EFMs, RTUs, and PLCs may be used to monitor compressor performance (e.g., compressor rpm, compressor inlet pressure, and compressor outlet pressure, among other values) at compression stations. The data collected by the EFMs, RTUs, PLCs, and other remote electronic devices may be gathered and stored by computer based systems. The computer based systems may be referred to as supervisory control and data acquisition (SCADA) systems. SCADA systems have many uses, including the management of energy production operations.

Other traditionally manual tasks are now performed electronically. For example, monitoring of cathodic protection elements on gas pipelines may be monitored with electronic, remotely accessible devices. Storage tanks for natural gas products may also be monitored electronically. As a result, many processes traditionally performed by field personnel have been converted to electronic methods to increase accuracy and reduce the amount of labor required to continuously monitor production and storage facilities.

Throughout natural gas gathering operations, it is important to have accurate metering of the gas volume and pressure and to have an accurate analysis of gas components. EFMs located at various positions along the pipelines and at production wells provide most of the volume and pressure data. These meters need to be calibrated frequently to make sure that they accurately measure pressure and flow volume. The testing process is laborious because field technicians must physically go to the meters, which are typically widely dispersed geographically, to perform the testing. In addition, gas purchase contracts generally provide the producer with the option to have a witness attend the meter testing so that test results may be verified. In some situations, contractual terms may dictate that these tests be performed based on the volume of hydrocarbon delivered over a selected period of time. Therefore, it can be difficult to predict the time when the EFM testing must be performed.

Proper gas sample analysis is also important for accurate measurement during gathering, processing, and sale of natural gas products. As mentioned previously, natural gas produced from different reservoirs typically has different chemical compositions. While EFMs measure pressure and volume of natural gas flow, it is necessary to measure natural gas composition so that the energy content of the gathered natural gas may be determined. "Energy content" typically refers to the amount of heat energy that is produced during combustion of the natural gas. Some natural gas compositions, for example those containing at least a fractional percentage of heavier hydrocarbons (such as ethane), produce more energy when burned as fuel as compared to combustion of pure methane. Energy content is important to gathering companies because natural gas sales are typically based upon energy in BTU/scf (British Thermal Units per standard cubic foot). Knowledge of natural gas composition enables gathering companies to accurately convert flow volume to BTU content. Contractual terms for the purchase of pipeline quality gas often set limits as to the energy content and component content. Therefore, the gathering company typically must send technicians to the field to take samples and then analyze the samples in the laboratories to determine the composition of the natural gas produced from each well. Further, NGLs produced and stripped by gas processing plants may be allocated to producing wells.

The overall production and delivery of natural gas must be balanced. That is, the amounts of natural gas and NGLs gathered from all producing wells tied to a gathering system must be balanced with the amounts of gas and NGLs delivered to customers and storage facilities. The balance procedure is traditionally performed periodically (e.g., monthly) when all of the volume, pressure, energy, and composition data are collected. If there is any imbalance, it is often difficult to determine the exact source because the absence of a centralized near real time database and the inherent latency in the collection of all required data.

While the collection of data from EFMs, RTUs, and PLCs has been automated through the use of SCADA systems, prior art automation approaches have achieved integrated operations only for selected segments of the process of gathering, processing, and distribution rather than for the entire production, gathering, processing, and final sale of natural gas. Traditionally, problems in each segment of natural gas gathering and distribution (e.g., physical testing and metering, system balancing, and natural gas composition analysis) have been addressed independently. The independent approach results in fragmented operations where operating data and information is not efficiently shared between segments. Furthermore, multiple entries of continuously changing data can create accounting errors and inconsistencies between segments.

There is, therefore, a need for a system that coordinates the many tasks that are included in the processes surrounding the production, gathering, processing, and sale of natural gas and other hydrocarbons. The system should combine many of the tasks and should eliminate errors resulting from the fragmented management and production processes.

SUMMARY OF THE INVENTION

One aspect of the invention is a method for the automated management of hydrocarbon gathering systems. The method comprises collecting data from a plurality of automated measurement and control devices positioned in a hydrocarbon production system. The collected data is compared with data stored in a database. The data comparison is used to automatically schedule tests of at least one of the plurality of automated measurement and control devices.

Another aspect of the invention is a method for using the collected data to allocate production costs and salable volumes of hydrocarbons to at least one of a plurality of producing wells.

Another aspect of the invention is a method for using the collected data to calculate a system balance for hydrocarbon gathering systems.

Another aspect of the invention is a method for using the collected data to calculate a hydrocarbon composition of flow in a hydrocarbon gathering system.

Another aspect of the invention is a method for using collected and stored data to automatically generate periodic reports concerning the status of the gathering system.

Other aspects and advantages of the invention will be apparent from the following discussion and attached claims.

DETAILED DESCRIPTION

The collection, management, and distribution of data used in the production, gathering, processing, and delivery of hydrocarbon products is important to the success of a gathering company. Data related to operations from production to delivery must be collected and delivered to both field and management personnel so that informed decisions may be made in the continuation of the natural gas gathering process. The discussion of the invention will focus on the gathering of natural gas and its derivatives. However, the invention is also useful for automating other processes, including other hydrocarbon gathering processes (e.g., the gathering of liquid petroleum products).

The invention has many advantages and components, each of which will be discussed in detail. Specifically, the invention provides a mechanism for coordinating physical testing and metering, well testing, system balancing, natural gas sampling analysis, monthly facilities reporting, and daily production reporting of data collected by a computer based system. All of the these aspects of the invention have several common elements.

Figure 1:
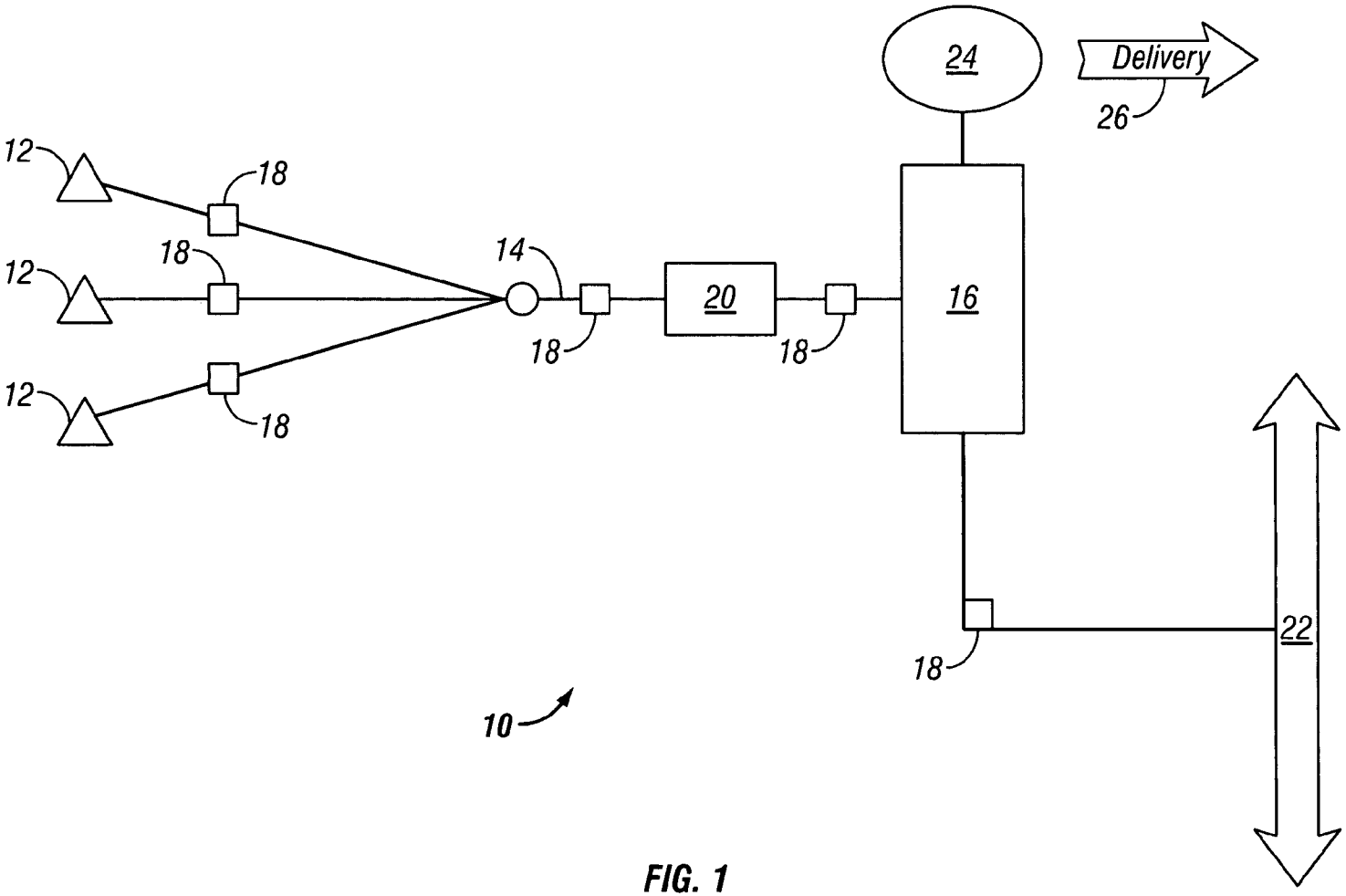
FIG. 1 (Prior Art)
FIG. 1 shows a prior art hydrocarbon gathering system.
Figure 2:
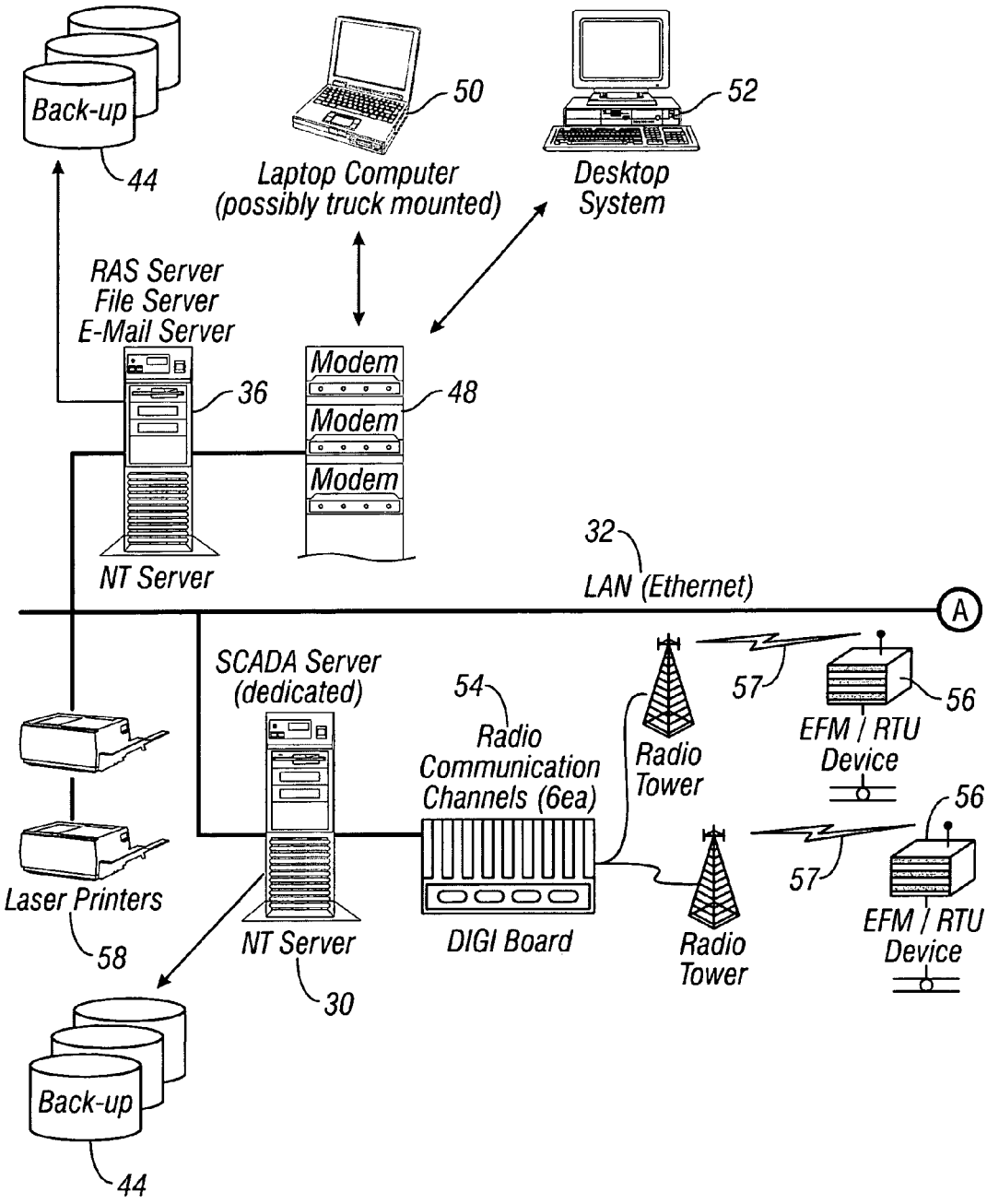
FIG. 2 shows an example of a network configuration that may be used in an embodiment of the invention.
Figure 2:
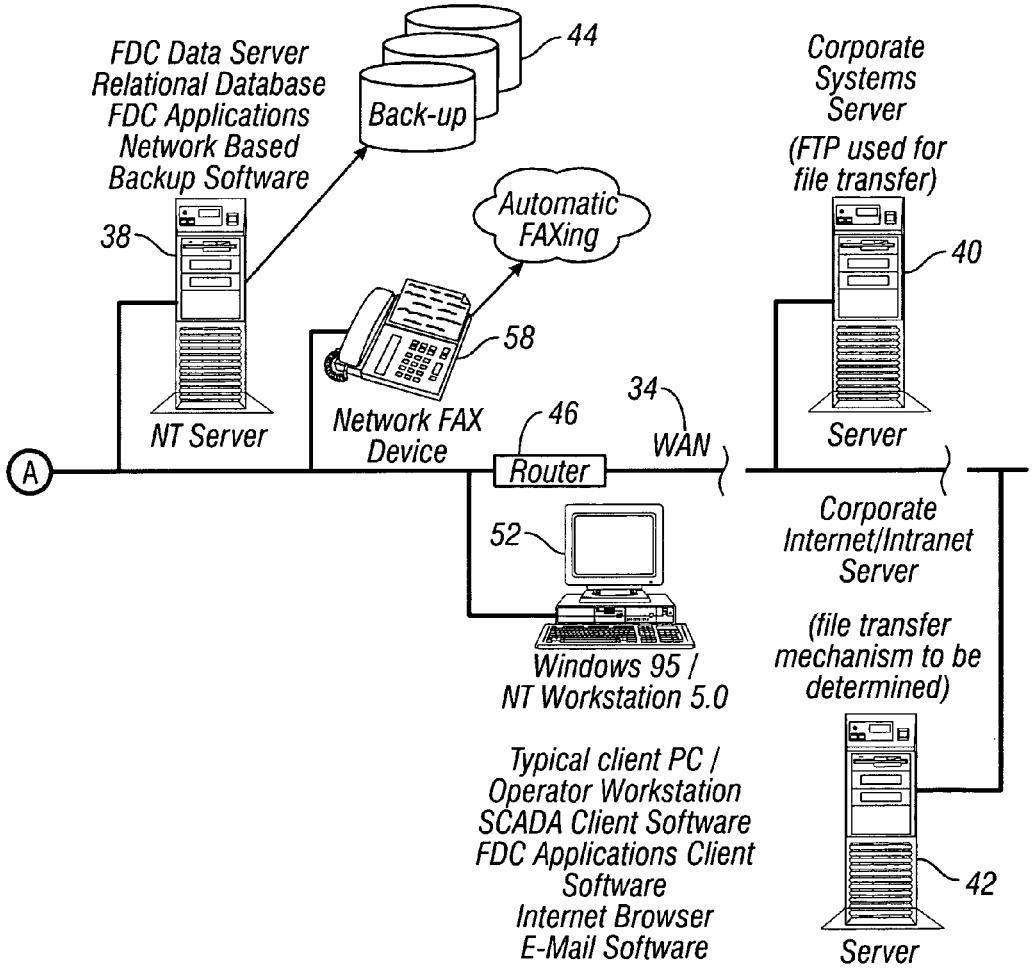

In an embodiment of the invention, the natural gas production control system is a computer based system where interactions between various components in the system can be performed via Internet or intranet connections, local area networks (LANs), wide area networks (WANs), radio links, or similar technology, singularly or in combination. An example of a computer based embodiment of the invention is shown in FIG. 2. The example system shown in FIG. 2 is provided to help clarify the invention and is not intended to limit the scope of the invention or to limit the invention to a particular hardware configuration.

FIG. 2 shows a plurality of servers connected to a LAN 32 and to a WAN 34. The servers include a dedicated supervisory control and data acquisition (SCADA) server 30, a remote access server (RAS) 36, an FDC data server 38, a corporate systems server 40, and a corporate internet/intranet server 42. The RAS server 36, the SCADA server 30, and the FDC data server are interconnected with backup devices 44 that store additional copies of the data on the servers. The LAN 32 is connected to the WAN 34 via a router 46.

The RAS server 36 permits remote access by selected users (refer to 224 in FIG. 3) via modems 48. For example, field technicians with laptop computers 50 or workstations 52 can connect to the LAN 32 through the RAS server 36. Moreover, remote access is available through direct Internet connections to the LAN 32. Therefore, clients, field personnel, or other users can connect to the LAN 32 through directly connected workstations 52.

The SCADA server 30 collects data from, for example, radio communication channels 54 that receive automated EFM/RTU/PLC 56 data communicated via radio telemetry links 57. The entire system is automated so that data collected from the EFM/RTU/PLC devices 56 is transmitted throughout the system (e.g., to all users and to the FDC data server 38) in near real time. Various output devices 58 (such as automated printers and facsimile machines, among other devices) are connected to the LAN 32 and the WAN 34 so that hard copies of data can be printed or retransmitted.

An embodiment of the invention comprises a supervisory control and data acquisition (SCADA) system. The SCADA system is typically established with commercially available software, such as the software system sold under the name "iFix," which is a mark of Intellution, Inc., of Foxborough, Mass. Another common element is a field data capture (FDC) system, which is used for data capture and control. The FDC system in this embodiment is also typically established with commercially available software, such as the software system sold under the name "FieldView," which is a mark of Merak Projects, Inc., of Houston, Tex. The SCADA and FDC systems work in combination through a common interface to gather data in near real time, establish a historical database of process related information, and manage data in the natural gas gathering and delivery process. The SCADA and FDC systems can also be used in combination with custom software applications that may be necessary for users to interact with the systems and for various components in the system to interact with each other. Therefore, in the following discussion, a referral to the "SCADA/FDC system" also refers to custom software applications and associated hardware that work in combination with the SCADA/FDC software and hardware.

Further, in the invention, the SCADA and FDC systems include custom applications that form a management automation and reporting system (MARS). The SCADA and FDC systems may reside on the same computer/server or on a plurality of computers/servers, and the exact configuration of the MARS will depend on specific needs of the user.

The SCADA software is typically used to communicate with a plurality of remote devices located in geographically diverse locations. The plurality of remote devices comprises electronic flow meters (EFMs), remote terminal units (RTUs), programmable logic controllers (PLCs), and remote natural gas analyzers, among other devices. The plurality of remote devices may be linked to the SCADA software through conventional "hard-wired" communication circuits or through radio telemetry, network communication via computer modem, or similar technology. The SCADA software captures data from the plurality of remote devices and locations and stores the data in a historical database that may be accessed by the FDC software and by selected users and applications for analysis and reference. The actual configuration of the FDC and SCADA systems depends on the demands and hardware capabilities of various production and delivery facilities. Similar factors influence the selection and development of custom software applications that run in combination with the SCADA and FDC systems.

With the plurality of EFMs, RTUs, and PLCs properly interfaced with the SCADA server, the system can automatically capture natural gas gathering data in an accurate and timely manner. The accurate and timely availability of information can be used to optimize commercial transactions (as will be shown, for example, in the optimization of the delivery and sale of natural gas and NGLs through the use of system balances) as well as the production, gathering, processing, and storage of natural gas and, for example, NGLs. This information can also be used by geoscientists and reservoir engineers in the evaluation of new and existing wells. In addition, this information can be provided to an accounting segment to assist in the computation of accounts payable and receivable. Furthermore, accurate and time-stamped information can provide documentation for compliance with government regulations. While paper documents, or hard copies, are still used to maintain file records by production companies, the electronic information available to both field personnel and management personnel greatly improves the knowledge of conditions in the gathering system.

Field technicians and remotely located personnel may communicate with the SCADA system for the purpose of entering data as well as monitoring facilities. This may be accomplished via personal computers (PCs) equipped with SCADA client software and modems. The PCs may communicate with the SCADA system via the existing network RAS (remote access service) servers using secure identification technology requiring the entry of usernames and passwords.

Figure 3:
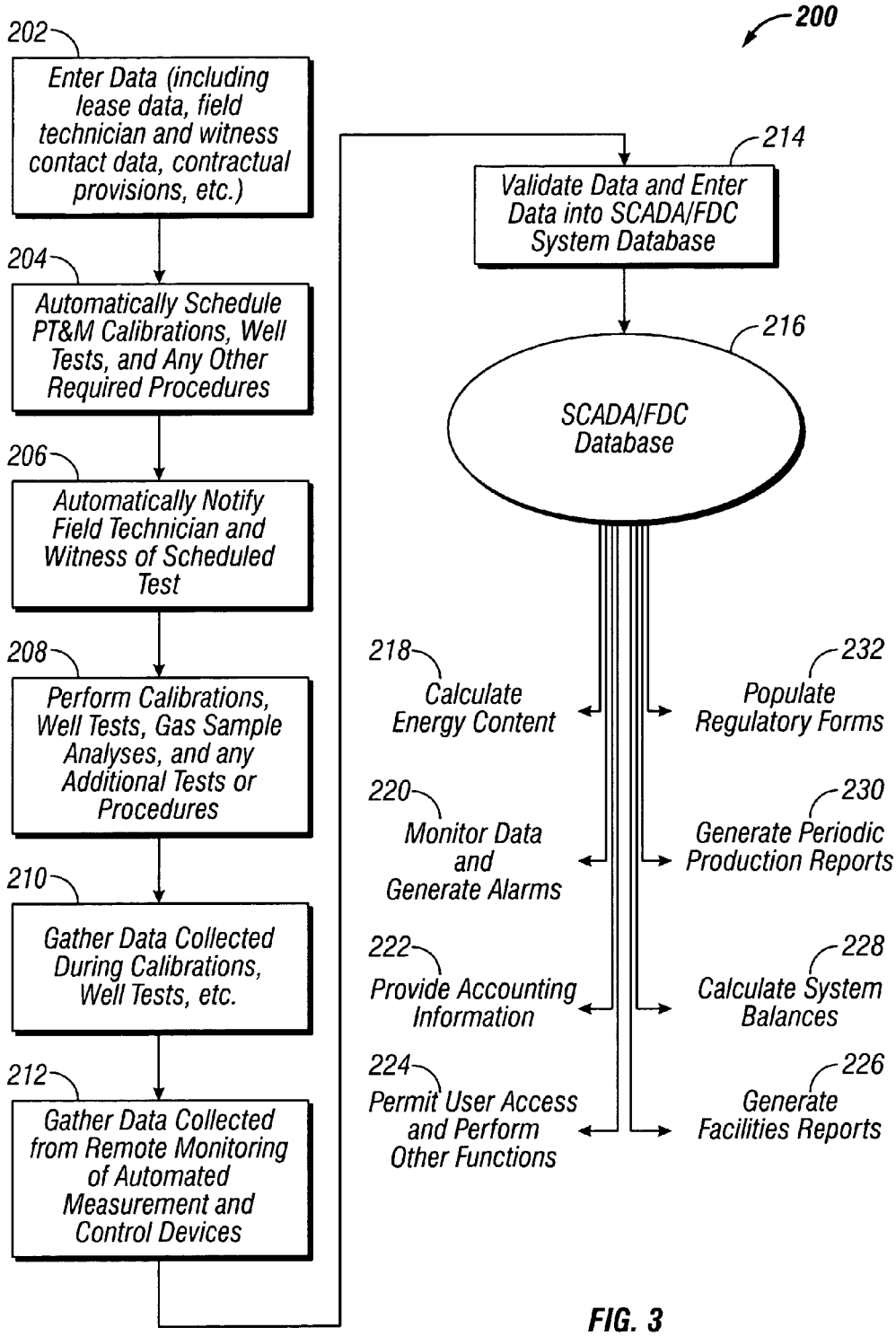
FIG. 3 shows a simplified diagram of a management automation and reporting system of an embodiment of the invention.

Elements of the MARS system may be used to perform specific automated functions related to the management of the natural gas production, gathering, processing, and distribution process. Applications of the current invention comprise processes such as well testing, physical testing and metering, automated system balancing, natural gas sample analysis, facilities report generation, production report generation, etc. A simplified diagram of the MARS system 200 is shown in FIG. 3. The following discussions describe the various applications of the invention.

Physical Testing and Metering

In one aspect, the invention comprises a method for physical testing and metering of a natural gas gathering system. The physical test and metering (PT&M) process is a data collection and test scheduling process that is typically carried out whenever a meter (nominally an EFM used for sales or allocation purposes) requires testing due primarily to contractual requirements.

Figure 4:
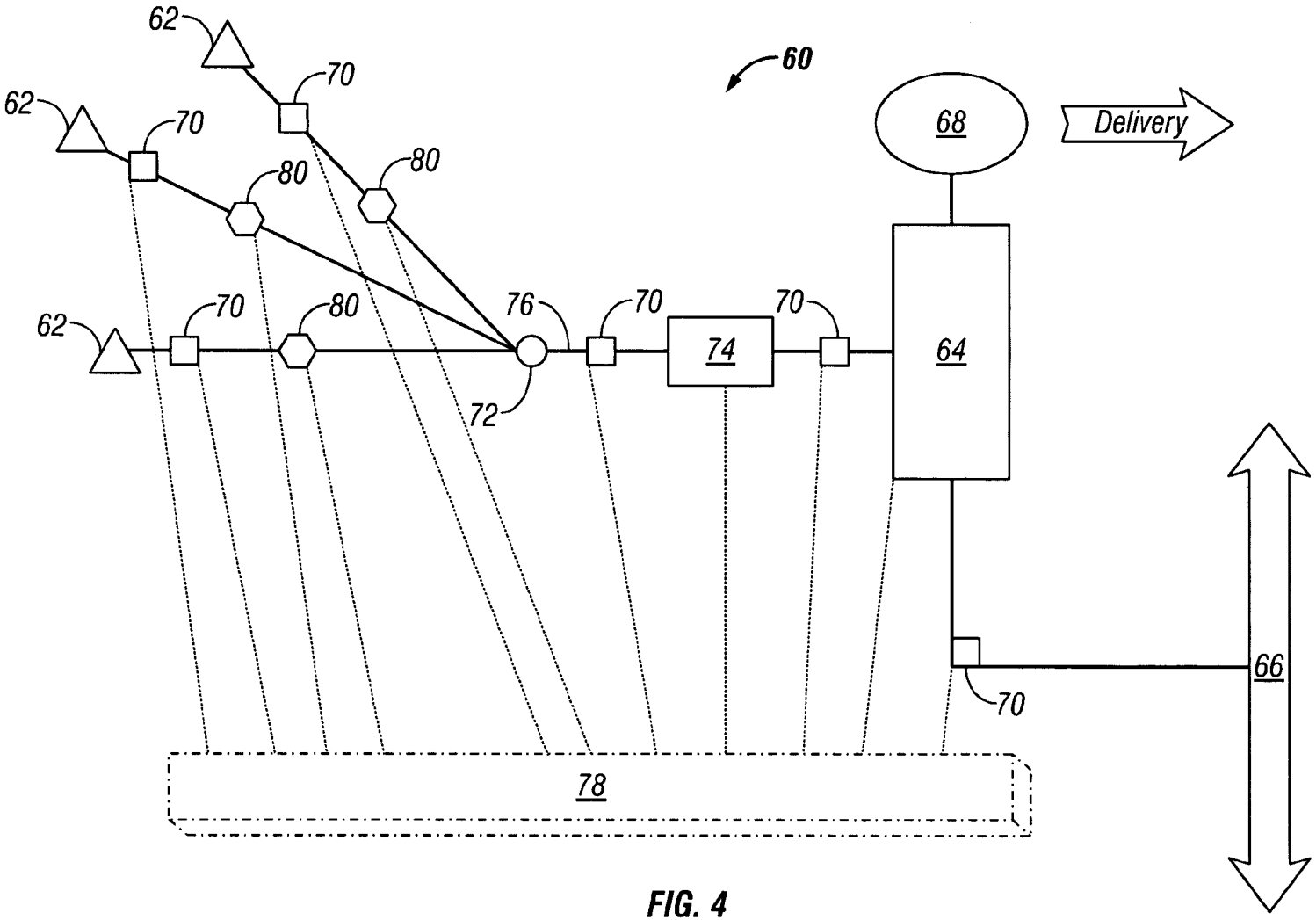
FIG. 4 shows an example of a natural gas gathering system of an embodiment of the invention.

An example of a natural gas gathering system of an embodiment of the invention is shown in FIG. 4. In the gathering system 60 shown in FIG. 4, the flow of natural gas from producing wells 62 to gas processing plants 64, and then to pipelines 66 or storage facilities 68, is monitored with a plurality of electronic flow meters (EFMs) 70. EFMs 70 are generally located at custody transfer points 72, production wells 62, third party sales points (not shown), compressor stations 74, and other critical pipeline intersection points in the gathering system 60. "Custody transfer points" 72 are locations where natural gas ownership is transferred from a producer (e.g., from producing wells) to the gathering company, from the gathering company to a pipeline, etc. The custody transfer point 72 may be at the location of the producing well 62 or, alternatively, may be located at a designated point in a gathering line 76 that gathers the produced natural gas from multiple wells 62. An EFM 70 is typically located integrally with each gathering line 76 to ensure that the total flow volume produced by the aggregate of the producing wells 62 feeding the gathering line 76 equals the total flow volume in the gathering line. The information from the EFMs 76 is polled by the SCADA/FDC system 78 and is used to manage the gathering of natural gas in near real time and to maintain an accurate record of the performance of a well, field, region, or similar unit.

In addition to EFMs 70, a plurality of programmable logic controllers (PLCs) (not shown) and Remote Terminal Units (RTUs) (not shown) are used in the PT&M system. PLCs and RTUs (not shown) may be used, for example, to remotely control compressors 74 that boost gas pressure on pipelines. PLCs and RTUs (not shown) may also be used to remotely monitor cathodic protection systems (not shown) in pipelines by remotely polling rectifier voltages and currents (not shown) flowing in a selected portion of a pipeline. Here, "cathodic protection" refers to the use of electric current to prevent corrosion in metal structures (e.g., the pipelines). Further, additional devices, such as remotely operated natural gas sample analyzers 80, among other devices, may be monitored and polled with PLCs and/or RTUs (not shown).

The SCADA/FDC system 78 integrates measurements from the plurality of EFMs 70, PLCs (not shown), RTUs (not shown) and other devices, and provides near real time production monitoring and processing data for both automated analysis and analysis by selected users. Therefore, it is necessary to ensure that the readings polled by the SCADA/FDC system 78 are accurate. The plurality of EFMs 70 must, as a result, be periodically calibrated to ensure the accuracy of their measurements and to meet contractual requirements (refer to block 208 in FIG. 3). The PT&M testing process can be broken down into two parts: automatic scheduling of the tests (refer to block 204 in FIG. 3) and entry of the test results (refer to block 206 in FIG. 3). An example of the PT&M process is shown in FIG. 5.

Figure 5:
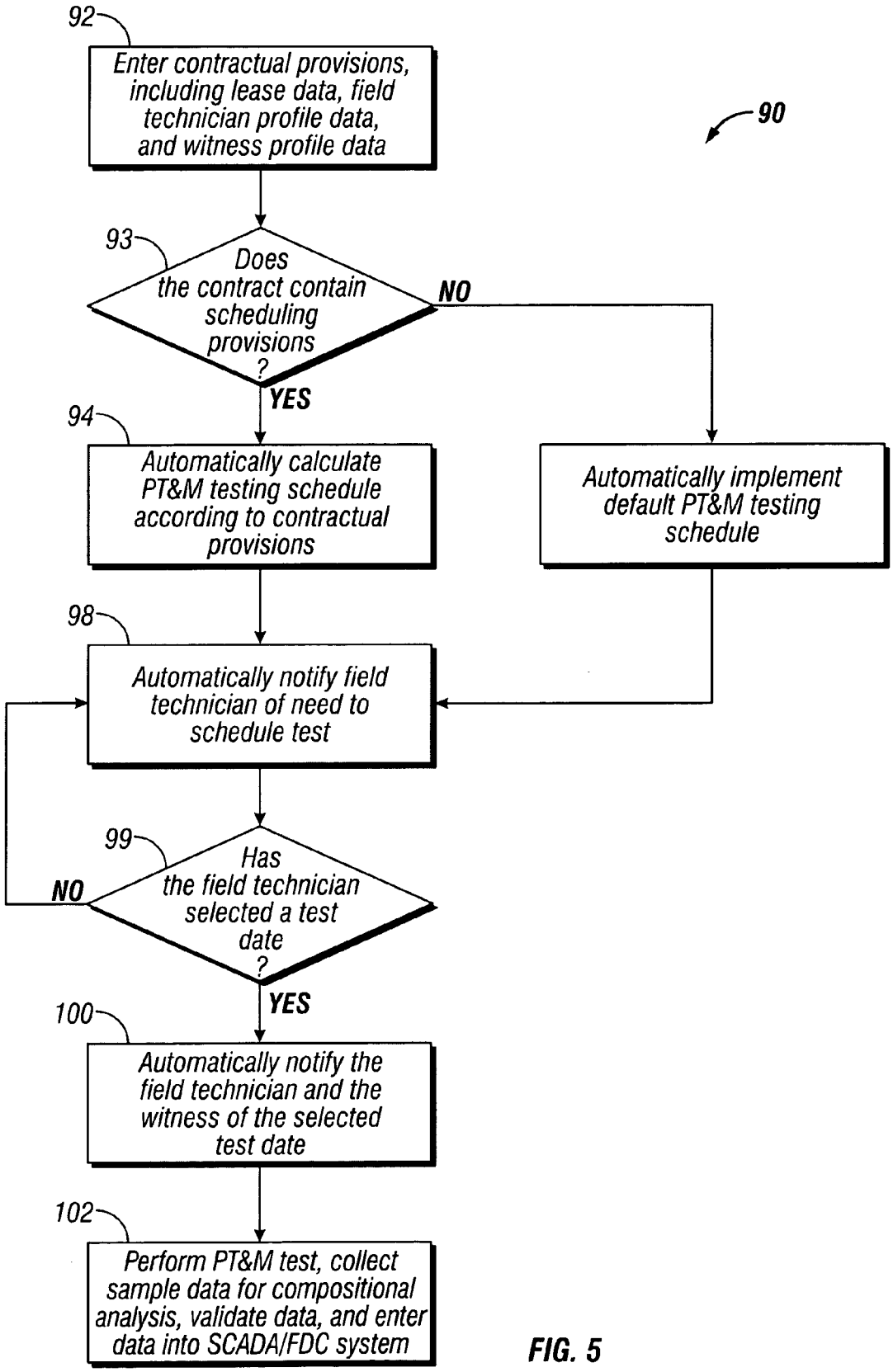
FIG. 5 shows an example of a physical testing and metering process in an embodiment of the invention.

Referring to FIG. 5, the first part of the PT&M process 90 provided by an application of the invention is the automatic scheduling of EFM testing in accordance with a selected testing frequency. Automatic scheduling of tests for cathodic protection systems may be performed in a similar manner. The selected testing frequency may be defined by contract provisions entered into the system 92 (refer also to block 202 in FIG. 3). For example, after data is entered into the system 92, a query is made as to whether the contract provisions contain scheduling requirements 93. A contract typically contain either a fixed, predetermined testing frequency or otherwise indicates that the meters are subject to volume-based testing. Volume-based testing provides for a test schedule based upon a selected amount of natural gas flowing through the meter over a selected period of time. The total volume of gas flowing during the selected period determines the frequency for calibrating the EFM. If a contract provides for volume-based testing, the invention measures the flow volume in the system with the EFMs and automatically determines when a meter test should be performed 94 according to the provisions of the contract, which are entered in to the system 92. If there are no specific provisions in a contract related to meter testing, a default testing frequency established by the production and/or gathering company is typically implemented 96. However, even if a default schedule is used, tests can still be scheduled automatically by the SCADA/FDC system.

In another aspect of the invention, an "editor" or other individual enters contract provisions 92 into the SCADA/FDC system. The SCADA/FDC system integrates the measured flow volume from the EFMs in near real time and compares the integrated flow volume to the contract provisions. When the SCADA/FDC system determines that a test should be scheduled 94, the system automatically notifies a field technician 98. The field technician then has a period of time to choose from (e.g., such as 30 days) in selecting a test date. After the test date has been selected 99, the date is entered into the SCADA/FDC system. Moreover, once the test date has been selected, the SCADA/FDC system or a custom software application will automatically notify (e.g., by telephone, e-mail, pager, voice mail, or similar communications system) the field technician 100 of the pending test. The SCADA/FDC system may be configured to, for example, send the field technician reminders with increasing frequency as the test date approaches. Further, the system may also be configured to send a notification to a supervisor or other individual if a field technician fails to schedule the test within a selected period (e.g., within a week of initial notification). The system may also produce an alert that notifies an individual or application to generate a form letter or other hard (e.g., non-electronic) copy notification of the upcoming testing. Automatic notification ensures that testing is performed in a timely, reliable manner and may help reduce the human workload.

As previously mentioned, contractual provision between producers and gatherers typically provide the producers with the option to have a witness attend a meter test to verify the test results. Another aspect of the invention provides for automatic notification of the witness 100 in a manner similar to the notification of the field technician. For example, once the field technician selects a date for the meter testing, the SCADA/FDC system may produce an automatic notification that sends a message to the witness and informs the witness of the test date, location, etc. via an automatically generated letter, e-mail, pager notification, or similar method of communication.

Therefore, the SCADA/FDC system provides for automatic notification of both the field technician and the witness in order to ensure proper and timely meter testing and to ensure compliance with contractual provisions. Notification is typically based upon field technician and witness profile information that has been entered into the SCADA/FDC system (refer to block 202 in FIG. 3). For example, when contractual provisions are entered into the system by an editor, information (including, for example, e-mail addresses, phone numbers, fax numbers, etc.) about selected witnesses for meter testing may be entered as well. The SCADA/FDC may use the witness information and similar information about field technicians to produce the automatic notifications.

In another aspect of the invention, the SCADA/FDC system may be configured (e.g., with a custom software subroutine) to resolve scheduling conflicts between the field technician and the witness. For example, the field technician may enter information about the witness and include selected dates when the witness cannot be present at a testing. The SCADA/FDC system may then notify the field technician automatically if the field technician selects a test date that conflicts with the availability of the witness. The system may also be configured to produce an alarm or other notification if a witness or field technician subsequently requests that the testing be rescheduled.

After the field testing has been completed (refer to block 208 in FIG. 3), the field technician may enter the testing 102 (refer also to block 210 in FIG. 3) data into a processor on the meter. Alternatively, the field technician may store the testing information in a hard, or paper, copy or on the hard drive (or other storage media) of a PC, such as a laptop computer. The field technician may then download, or export, the data by manually entering the data 102 into the SCADA/FDC database (refer to block 216 in FIG. 3) or by connecting to the database via a network connection (such as a modem or Internet connection) and then downloading the testing data. The field technician may also enter the test data 102 directly in to the SCADA/FDC database via a remote network connection.

The results of field testing may also be automatically reported to the supervisors of the field technicians. The supervisors may evaluate the timeliness and accuracy of the results of the testing to monitor the performance of field technicians.

Similar alerts or alarms may be automatically generated by the SCADA/FDC system in the event of a selected (or unanticipated) event. For example, the automated SCADA/FDC system can produce an alert if a remotely monitored EFM detects a change in flow rate beyond a selected threshold (indicating a reduction or increase in the volume of natural gas flowing in a gathering line). Other notifications may be produced by the failure of an EFM or a PLC, or for detection of a trend in stored data. For example, evaluation of stored data may indicate a trend toward declining production from a selected well or toward the provision of unreliable data by a selected EFM. The alerts may be forwarded to a field technician or to another individual who may take appropriate steps to resolve the problem. This type of alert generation scheme produces a "management by exception" environment. Here, "management by exception" refers to operations where processes are substantially automated and self-governing, and where management intervention is required only in the event of preselected or unanticipated occurrences.

The invention may also automatically produce reports for management and field personnel that include information related to the efficiency of natural gas production, gathering, processing, and delivery and testing procedures. The reports may also include, for example, information related to compliance with contractual specifications.

The calibration of cathodic protection systems may be performed in a manner similar to meter calibrations. Cathodic protection systems typically operate by providing electrical current flow in, for example, a pipeline. The current provides free electrons that are captured by metal ions. Provision of free electrons helps prevent oxidation (e.g., rust or corrosion) of the metal because, in the absence of the free electrons provided by the current, the metal ions would typically attract oxidizing electrons from other sources (e.g., from oxygen atoms). Testing and monitoring of cathodic protection systems typically involves physical examination of the protected structure (e.g., the protected pipeline) to observe if sufficient current is being provided to prevent rust, corrosion, etc. If, for example, rusting of the protected structure is observed, it may be necessary to increase the electrical current to provide more free electrons. Periodic monitoring and testing of the cathodic protection systems helps ensure that pipelines and other metal structures are not damaged or structurally weakened by oxidation, etc.

Monitoring of cathodic protection systems may also be performed automatically. For example, a PLC or RTU may be used to measure current flow in the protected pipeline. If the measured current drops below a selected threshold, an alarm may be generated and electronically transmitted to, for example, a field technician. The field technician may then, for example, adjust the current flow in the cathodic protection system and perform any necessary repairs.

Well Testing

In another aspect, the invention comprises a method for testing production wells in a natural gas gathering system (refer to the simplified diagram of the invention shown in FIG. 3). Well testing is typically accomplished by flowing a producing well into a well test system that simulates normal operating conditions and then measuring flow rate and pressure. Well test data may be collected manually or electronically, depending upon the specific configuration of the producing well and well test system. When collecting well test data manually, a field technician travels to a selected well site and manually performs a well test using a portable or fixed well test system comprising flow meters and, for example, separation equipment. The well test may include, among other tests, a 24 hour gas flow rate test, a 24 hour condensate flow rate test, a 24 hour water flow rate test, a 24 hour shut-in well head pressure test, a natural gas specific gravity test, an American Petroleum Institute (API) gravity test, and a flowing tubing pressure test.

In a manner similar to that described above for PT&M testing, EFMs used for well test procedures are typically electronically interfaced with the SCADA/FDC system (e.g., via radio links, network communication, or similar technology) and provide information concerning the flow of natural gas from the producing well to the SCADA/FDC database.

Well test data may be used for several aspects of the gathering, processing, and delivery of natural gas. For example, well test data is typically stored in the SCADA/FDC database so that the data may be accessed by users (such as production engineers) and compared to later well test data.

Figure 6:
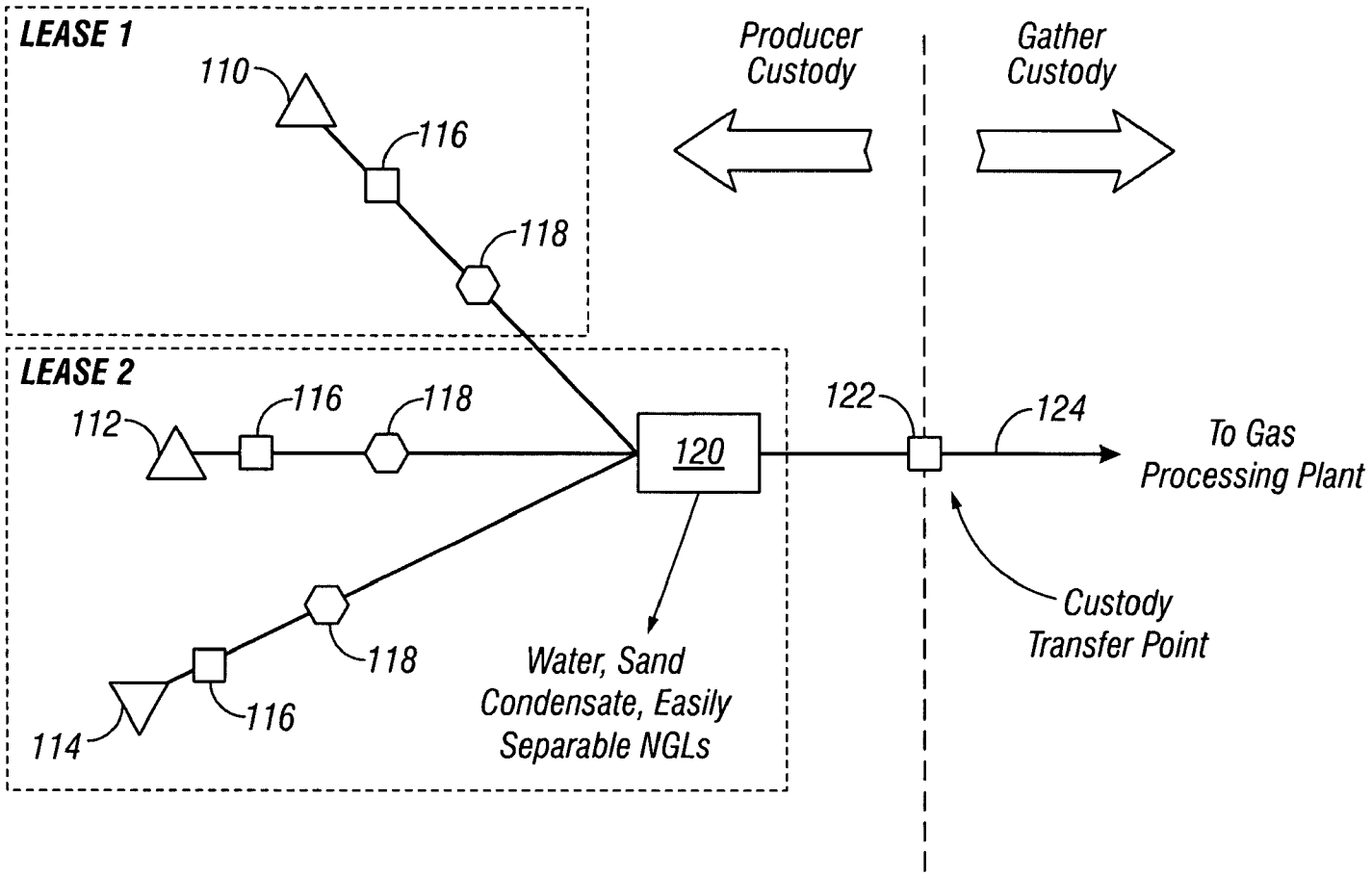
FIG. 6 shows an example of how well test data is collected and used to allocate production costs between wells.

Well test data is also used in both accounting and regulatory functions. Well test data is important to accounting personnel because producers must be accurately compensated for the natural gas extracted from their wells. Well tests allow the gathering company to obtain accurate data concerning the volume and content of the natural gas produced from a selected well so that a sales volume (e.g., a volume salable of natural gas and hydrocarbon liquids (NGLs) collected from the producing well and sold to customers) may be accurately allocated back to the selected well and, therefore, to the selected producer. For example, referring to FIG. 6, natural gas produced from a wells 110, 112, and 114 may include quantities of dry gas and heavier hydrocarbons (e.g., methane and ethane) as well as other components such as condensates and dilutents/impurities such as sand and water. Well test data enables gathering companies to track the exact content of the natural gas produced by the selected well so that the owner of the selected well may be compensated for the correct quantity of salable natural gas and NGLs.

Well test data is also useful in allocating production costs back to the wells 110, 112, and 114. Measurements may be taken at the wells 110, 112, and 114 by, for example, EFMs 116, gas sample analyzing devices 118, and similar measurement devices. The natural gas produced by the wells 110, 112, and 114 may require processing 120, such as, for example, desanding, dehydrating, compressing, treating, separation of condensates and NGLs, etc. in order to produce natural gas of a quality suitable for gathering in a gathering line 124. For example, if the natural gas contains quantities of sand and water, the gas may be processed 120 with a desander and a dehydrator to remove the impurity (sand) and dilutent (water). After processing 120, the natural gas collected from the wells 110, 112, and 114 is collected in the gathering line 124 and the flow volume (e.g., the line pressure) is measured with another EFM 122. The measurements taken by the EFMs 116 at the wells and the EFM 122 in the gathering line differ because the EFMs 116 at the well handle "wet gas" (e.g., natural gas that has not been processed) while the EFM 122 at the custody transfer point handles "dry gas" that has been processed 120 to remove liquids but which may still contain heavier hydrocarbons and impurities in gaseous form (e.g., carbon dioxide, water vapor, hydrogen sulfide, etc.). The costs associated with the processing 120, including desanding, dehydration, compression, treatment, and/or separation must be allocated to the well 110, 112, and/or 114 that produced the natural gas in need of additional processing 120 so that other well owners (whose wells, for example, produce natural gas that does not require treatment) will not be charged for the extra processing. For example (referring to FIG. 6), wells 112 and 114 on lease 2 may produce natural gas that needs additional processing 120 while the well 110 on lease 1 produces substantially dry gas that is suitable for direct transfer to the gathering line 124. The gathering company must allocate extra processing costs for the gas produced by wells 112 and 114 to the owner of lease 2 by deducting the processing costs from payments for salable natural gas. In contrast, the owner of lease 1 (and well 110) is compensated for salable natural gas without deductions for additional processing costs.

Well tests also produce data that is used to generate regulatory reports for state and local regulatory agencies. For example, periodic reports must be provided to regulatory agencies so that an allowable production rate may be established for a selected well. Well test data is typically used for this type of "production test," and the data must be updated periodically to reflect any changes in the volume of natural gas produced by the well. Production tests may include buildup tests and manual shut-in tests. These tests help determine the production capacity of the wells by determining a static reservoir pressure and drained area at the well.

When contractual information is entered into the SCADA/FDC database by a user or an editor (refer to block 202 in FIG. 3), the information typically includes information about the lease upon which the natural gas well is located. When updated well test data is collected in the field (refer to blocks 210 and 212 in FIG. 3) and is entered in to the SCADA/FDC system (refer to blocks 214 and 216 in FIG. 3), regulatory report forms may be automatically "populated" (refer to 232 in FIG. 3) (e.g., filled) with the new well test data and with applicable lease data. The automatically populated forms may then be printed and forwarded to appropriate regulatory agencies. This procedure may be repeated for a plurality of leases. Alternatively, the automatically populated regulatory forms may be automatically transmitted to regulatory agencies via electronic transmission (e.g., e-mail, facsimile, file transfer protocol (FTP), etc).

As a result, the well test procedure includes many of the advantages of the automated PT&M procedure. For example, reports are automatically produced and may be automatically forwarded to designated recipients. Moreover, data collected from well tests is entered into a common database shared by a plurality of users. These provisions ensure that reports are filed with the appropriate agencies in a timely manner and that data entry is coordinated to reduce errors produced by multiple entry of similar data.

System Balancing

Figure 7:
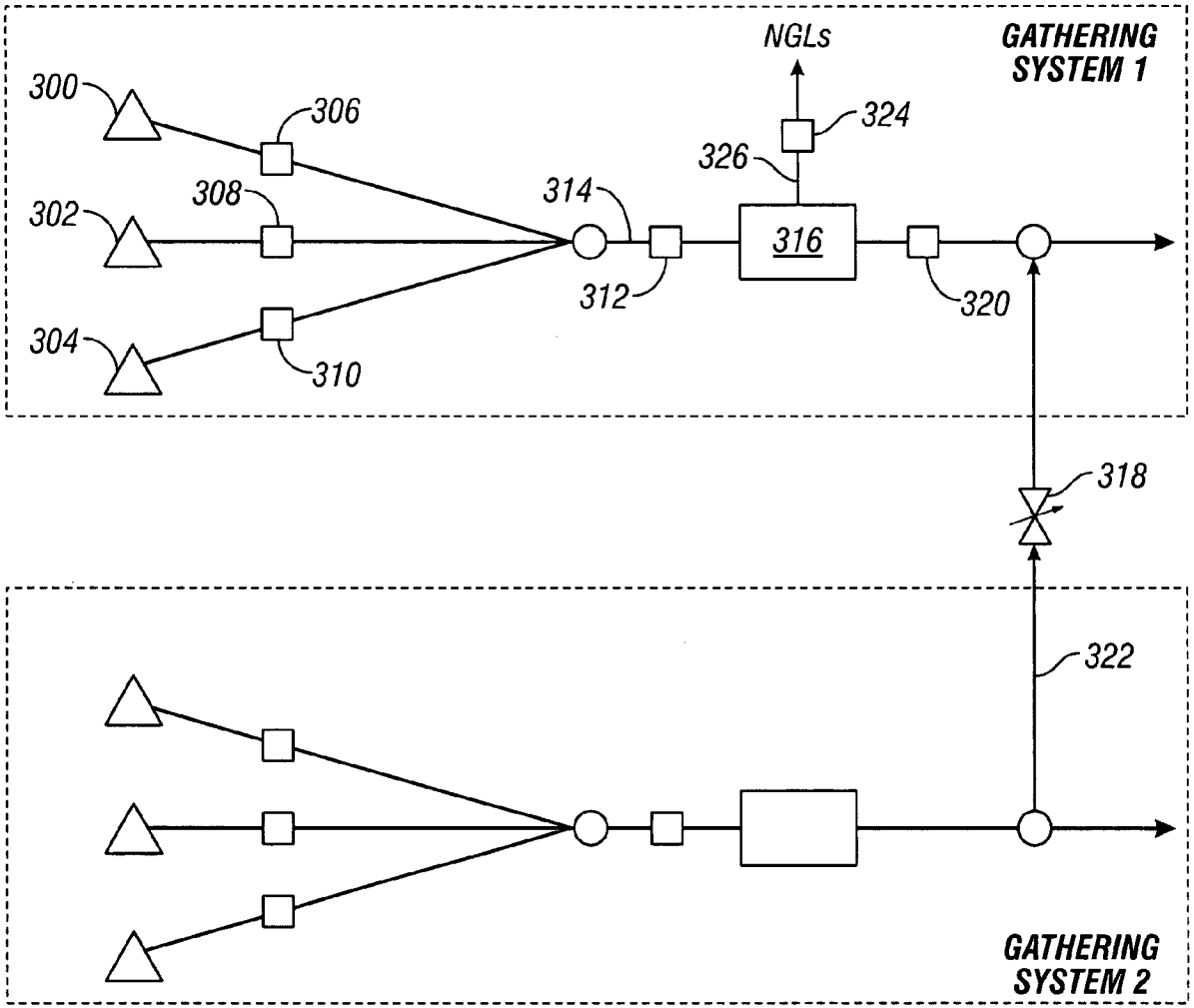
FIG. 7 shows an example of gathering systems that may be balanced in an aspect of the invention.

In another aspect, the invention comprises a method for automatically calculating a system balance (refer to 228 in FIG. 3) for hydrocarbon gathering companies. The system balance procedure is a tool that is used to calculate balances of natural gas produced and transported in the production, gathering, processing, and delivery system. Referring to FIG. 7, the system balance may be described as balancing the volume (e.g., in millions of cubic feet or "MCF"), heating value (e.g., energy content), or component volumes of natural gas entering a gathering line 314 or processing plant 316 against the volume, heating value, or component volumes of natural gas leaving the gathering line 314 or facility 316. For example, referring to gathering system 1 in FIG. 7, a system balance may be performed to compare the energy content of natural gas produced from a number of wells (300, 302, and 304) to the energy content of the natural gas (plus extracted NGLs, etc.) that has been gathered into a gathering line 314 and transported to, for example, a gas processing plant 316. The balance may be performed by comparing EFM (306, 308, and 310) measurements collected at producing wells (300, 302, and 304) with an EFM 312 measurement collected at the gathering line 314. The energy content (or heating value) of the natural gas in the gathering line 314 should be equal to the sum of the energy content of the natural gas produced from the wells (300, 302, and 304) that feed the gathering line 314. Further, an energy balance may be performed for natural gas entering the processing plant 316 and natural gas and extracted NGLs exiting the processing plant 316. This type of system balance may be achieved, for example, by comparing the EFM 312 measurement in the gathering line 314 at an entry of the plant 316 with an EFM 320 measurement in the gathering line 314 at an exit of the plant 316 and with an EFM 324 measurement in an NGL gathering line 326 at an exit of the plant 316. Similar balances may be performed for subsystems of the natural gas production, gathering, processing, and delivery to ensure that natural gas with the correct energy content is being provided to customers. For example (referring to FIG. 7), if gathering system 1 and gathering system 2 feed a common pipeline (not shown), a balance may be performed to compare the energy content of natural gas delivered by gathering systems 1 and 2 to the energy content of the gas in the common pipeline (not shown). Effectively, a balance may be performed for any unit (e.g., a pipeline, processing plant, or other unit) where natural gas or natural gas products enter and exit the unit.

The monitoring of system balances is very important to the natural gas industry. The gathering company must know exactly what quantity and quality of natural gas is being produced from each well that it gathers from so that it may be processed and transferred to customers or storage facilities according to company or contractual guidelines. For example, natural gas sales are typically based upon the sale of BTUs (e.g., the sale of energy rather than volume). Therefore, the gathering company must closely monitor the energy content (e.g., the BTU content) of natural gas gathered from producing wells so that BTUs may be correctly allocated between wells. BTU content must also be known so that the gathering company can make accurate payments to the producers. In summary, the gathering company must know whether the BTU content of natural gas produced at wells balances with the BTU content of natural gas gathered at, for example, a gathering pipeline or a gas processing plant. Maintaining the BTU balance in near real time is an important aspect of the invention and is valuable to the accounting aspects of the gathering company.

Further, the monitoring of system balances may alert the production company to the presence of a leak or a malfunctioning EFM (e.g., there may be a non-conformance or disagreement between hydrocarbon energy content data measured at two or more points in the gathering system). For example, if the amount of natural gas measured as produced at the wells does not match the amount of gas and other products delivered to a pipeline, there may be (1) a leak in the pipeline, (2) a malfunctioning EFM at one or more of the wells, or (3) another problem that requires the attention of a field technician. Further, an alarm may be produced if a system imbalance (as indicated by, for example, a disagreement in measured hydrocarbon energy content between two points in the gathering system) exceeds a preselected threshold. As a result, automatic monitoring of system balances creates another example of how "management by exception" may be applied to the production of natural gas. Field technicians, supervisors, or other personnel may be automatically notified (e.g., through electronic communication such as e-mail, etc.) if a problem has been detected.

System balance data is stored in the FDC database and is available for future analysis (such as historical trending). System balances are also automatically updated to reflect new testing data and new natural gas sample analysis data. The substantially instantaneous rebalance is another important aspect of the invention.

In another aspect, system balancing permits the creation of user-defined "balance envelopes." Balance envelopes are established by selecting which units and meters will be monitored for establishing the system balance. A balance envelope can be created with all meters that comprise a closed natural gas gathering system (e.g., all inlet meters and outlet meters in the gathering system) or with a subgroup of selected meters. Referring again to FIG. 7, a balance envelope for one user may include EFMs (306, 308, 310, 312, and 320) in gathering system 1 while a balance envelope for another user may include EFMs in both gathering system 1 and gathering system 2. Therefore, a near real-time system balance may provide a gathering company with an opportunity to timely identify problems with the gathering process as a whole or to identify problems in specific portions of the gathering operation. Users may define balance envelopes by, for example, selecting one or more meters displayed in a Fieldview system.

Further, even if there is no system imbalance or other detected problem, information from various balance envelope subgroups can be used to mix gas from different gathering systems (e.g., gathering systems 1 and 2 of FIG. 7) to achieve a desired component mix. For example, natural gas in gathering system may have a relatively high concentration of carbon dioxide. The gas of gathering system 1 may be mixed with natural gas from, for example, gathering system 2 (which has, for example, a substantially low carbon dioxide concentration) by diverting gas from gathering system 2 through a transfer line 322 by controlling a valve 318. As a result, the gas of gathering systems 1 and 2 may be mixed to produce natural gas that meets the pipeline and customer requirements while minimizing the amount of processing needed. Removal of carbon dioxide from natural gas typically requires the use of an amine unit whose operation is very expensive. If the gathering company can simply mix in natural gas from a different gathering line or system with a low carbon dioxide content so that the carbon dioxide level in the gathering line (with the higher carbon dioxide concentration) is reduced to an acceptable amount, the company can avoid running the amine unit and, as a result, can increase profitability and/or reduce operating expenses.

The ability to divert natural gas from one gathering system or from one gathering line to another is important to a gathering company and is enabled by the near real time balancing provided by the invention. With near real time balance information, a gathering company can make substantially instantaneous business decisions that improve the overall efficiency and profitability of the gathering process.

System balances are typically computed on a periodic schedule, such as on a daily or monthly basis. However, the balancing schedule may be changed at any time to reflect the needs of the gathering company. Changes may be facilitated by changing a parameter in the database, which automatically updates the system balance schedule.

The SCADA/FDC system may also be configured to provide system balancing reports to selected individuals, such as editors, accounting personnel, marketing personnel, and management (refer to 222 in FIG. 3). The system balance information, among other uses, may be used to ensure that quality and contractually specific natural gas products are delivered to clients and that the energy content of the natural gas is being managed to maximize income for the gathering company.

Sample Analysis

Figure 8:
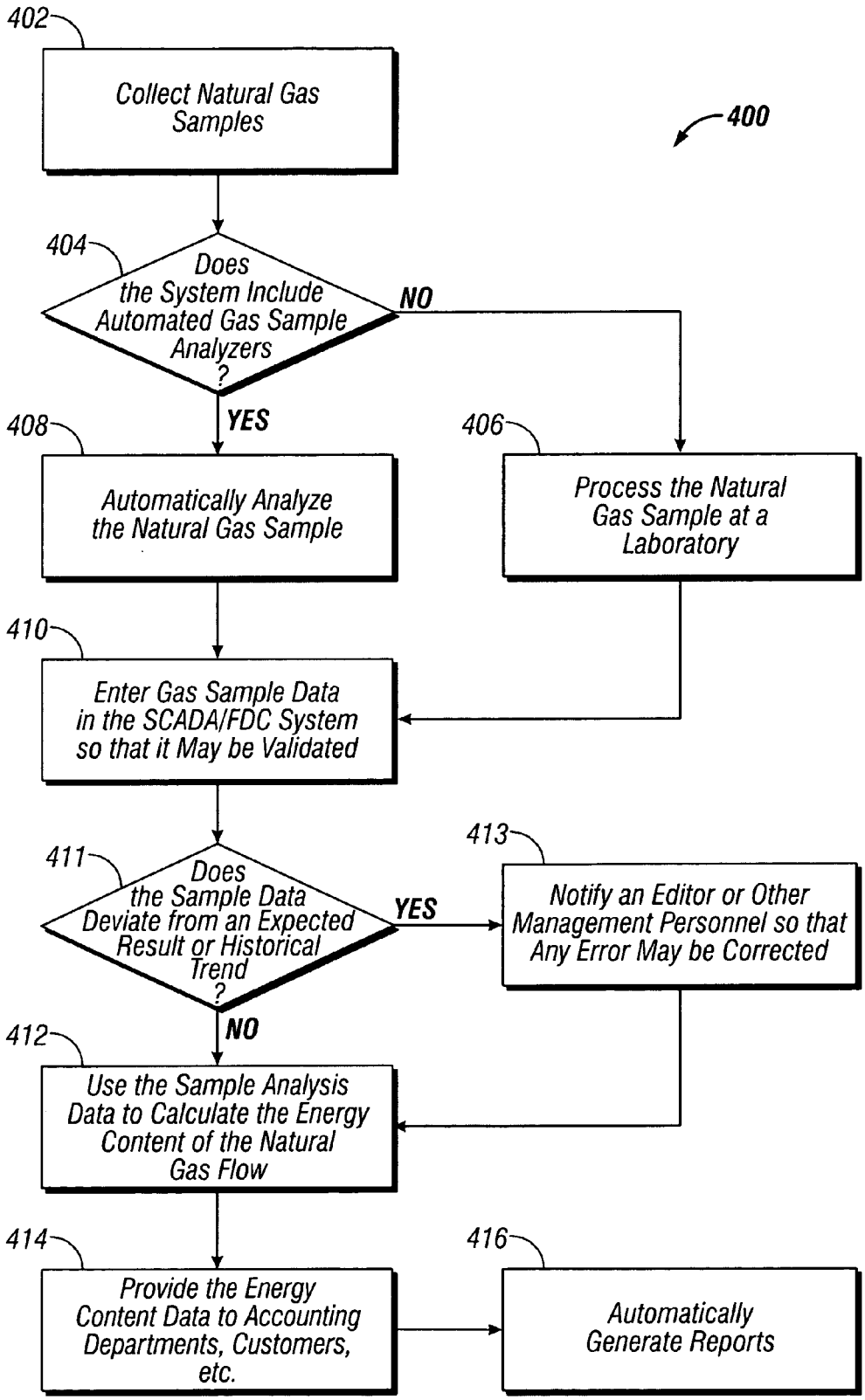
FIG. 8 shows an example of a natural gas sample analysis system in an aspect of the invention.

In another aspect, the invention comprises a natural gas sample analysis process. Referring to FIG. 8, the sample analysis process 400 is designed to receive sample composition analysis data in a formatted file from a laboratory 406 or automatic sampling device 408, to validate new composition data against historical sample composition analysis data stored in the FDC database 410, to validate new compositional data against contractual quality requirements, and to use the gas sample composition data to calculate the energy content (refer to 218 in FIG. 3) of natural gas produced from wells 412, among other uses. After calculating energy content 412, the information is provided to accounting personnel, customers, management personnel, etc. 414. An automated process control system (not shown) may be configured to automatically determine if automated gas sample analyzers or similar devices are present in the system 404. Regardless of whether automated gas sample analyzers are present, however, the automated process control system (not shown) may be configured to automatically schedule gas sample analysis tests using the scheduling process discussed previously in the discussion of physical testing and meter testing (refer to 90 in FIG. 5).

Actual sample analyses can be performed either manually in a laboratory 406 or automatically 408 using online detectors, such as gas chromatographs or other analysis devices located at producing wells or other selected locations, such as the inlets and outlets of a gas processing plant. Samples that are analyzed manually are typically collected 402 by field technicians from various locations in the gathering system (e.g., at each producing well) and taken to a laboratory 406 that performs the actual composition analysis. The composition analysis is primarily concerned with determining the energy content 410 (BTU/scf) and component content (e.g., a determination of the amounts of methane, ethane, butane, carbon dioxide, nitrogen, and other components present in the sample) of the natural gas.

Natural gas composition analysis data can be entered 410 manually by a technician in a manner similar to meter testing data. Alternatively, remote download and online entry of sample analysis data may be performed as in the testing procedure. Any variance 411 from an expected composition or energy content (e.g., when compared against data stored in the FDC database) or from a contractual gas specification will be displayed to an editor 413 who will then initiate procedures to determine the source of the variation. Further, any variance in hydrocarbon composition or energy content that exceeds a selected threshold may automatically generate an alarm that alerts, for example, an editor or field technician, who may then take action to determine the source of the variance or correct any error. Once the sample analysis data has been processed and the editor has approved the sample analysis data, the data may be automatically downloaded to selected systems, such as to EFMs located in the field and to the accounting system 414. The sample analysis process 400 also creates a formatted file of the laboratory sample analysis data to be imported into the FDC database. The sample analysis data may be made available to gas suppliers, operations technicians, and the business community 414.

Natural gas sample analysis 400 may also be performed automatically 408 in combination with the SCADA/FDC system. As mentioned previously, automatic sampling of natural gas in the gathering system may be performed by devices (such as gas chromatographs or similar devices) located in the field at producing wells and other locations, such as custody transfer points, EFM locations, pipeline inlets and outlets, etc. Automatic sampling of the natural gas provides significant advantages in that field technicians do not have to collect and analyze the data manually. Moreover, random samples may be taken to monitor for deviations from regional, customer, or company specifications.

Finally, whether sampling is performed automatically or manually, the system may automatically generate reports 416 concerning the natural gas sample analysis. The reports may be forwarded to editors, customers, or others and may be used to make business decisions concerning the production and processing of natural gas.

Generation of Facilities Reports

In another aspect of the invention, the system automatically generates facilities reports (refer to 226 in FIG. 3). Facilities reports include data concerning the operation of the entire production, gathering, processing, and delivery system. The reports are completed with data in the SCADA/FDC database that has been collected either manually or automatically and then entered in to the SCADA/FDC system.

Figure 9:
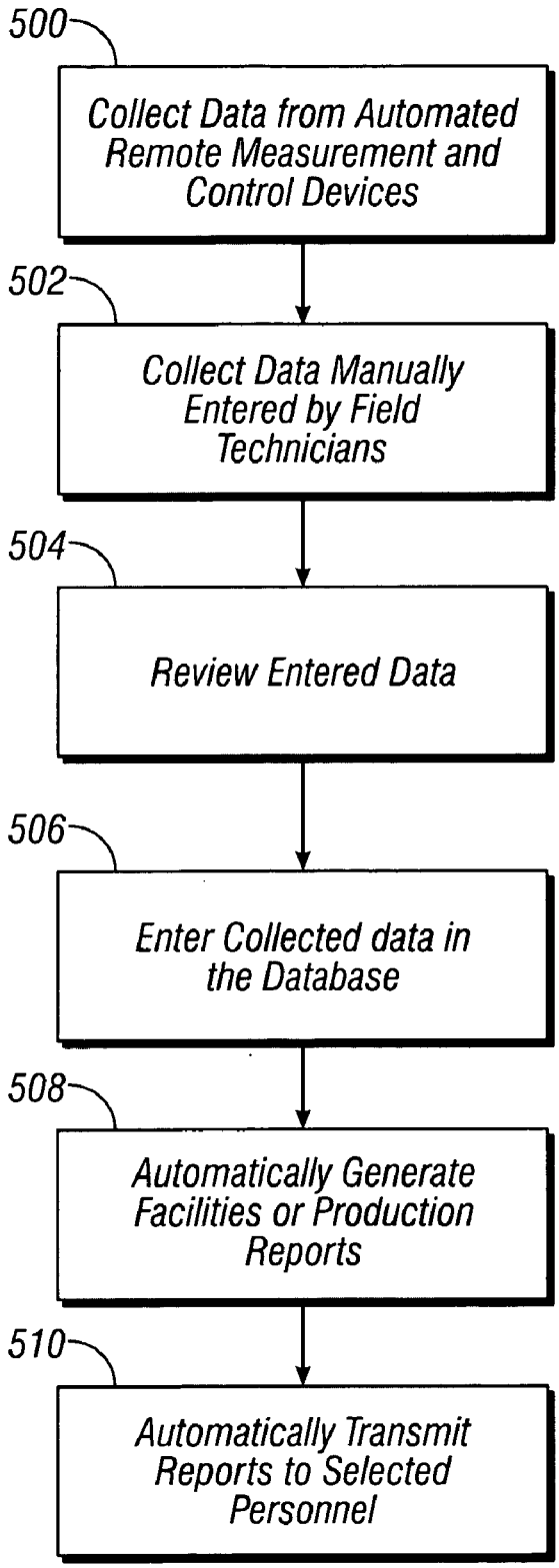
FIG. 9 shows an example of a report generation process in an aspect of the invention.

Referring to FIG. 9, data for the reports may be automatically monitored by automated remote measurement and control devices 500 (such as EFMs, RTUs, and PLCs) or may be entered by field technicians 502. For example, as previously described, system balance data and EFM measurements, among other data, may be remotely monitored by the SCADA/FDC system in combination with custom software applications. However, certain field data is generally manually entered into the database by field technicians. For example, natural gas from a producing well may have to be processed by a compressor or separator before entering a gathering line. Data related to the physical location of hardware and machinery (e.g., compressors, vapor recovery units, dehydrators, satellites, separators, etc.) is generally manually provided by field technicians 502 so that the SCADA/FDC system may be updated to reflect any new equipment allocation.

Advantageously, the data for the automatically generated facilities reports 508 are collected at one time (e.g., a specific day of the month) and are added to the central SCADA/FDC database 506. All other applications associated with the database are then automatically updated after the entered data has been reviewed 504 by, for example, an editor. Detailed, accurate data concerning equipment disposition and run-time is critical because, as mentioned previously, accounting personnel must allocate production costs to specific wells (e.g., the wells that require treatment by special equipment). Further, the availability of accurate well test data can assist with both volume and cost allocation and can provide field and management personnel with useful information concerning the natural gas gathering system. Field personnel are typically required to enter a notification that a well has been shut-in so that production costs and payments for produced natural gas are no longer allocated to the shut-in well.

The automatically generated facilities reports 508 help track any changes in the routing of gas from the production well to the custody transfer point (which may be at the well itself or at another location, such as a gathering line inlet) and, finally, to the point of sale. Personnel, such as production/operators, may use routing changes to change, for example, equipment in service listings and to note the physical changes in location of the equipment.

Automatic generation of accurate facilities reports 508 helps ensure that costs are correctly allocated in the gathering process. Accurate allocations protect the gathering company from lawsuits and ensure that all expenses are fairly distributed. Facilities reports may be distributed in several manners. For example, the reports may be automatically transmitted 510 electronically via e-mail, facsimile, or other methods of electronic communication. Further, the reports may be posted on an automatically updating Internet Web page. Notifications may also be sent to editors or other users that print the reports and distribute the hard copies to selected personnel.

Generation of Periodic Production Reports

In another aspect of the invention, and in addition to facilities reports, the system of the invention generates production reports 508 (refer to 230 in FIG. 3). Software applications of the prior art generate reports, for example, concerning natural gas sales volume for a relatively large division of a production field (for example, reports may be generated for a northern region, a central region, etc.). However, the invention provides automated reporting of the status of smaller units of the production field including, for example, the daily status of selected producing wells or of selected gathering lines fed by one or more producing wells. Further reporting units may include, for example, natural volume in high pressure gathering lines, natural gas volume in low pressure gathering lines, sales volume produced by selected wells, fuel gas volumes, condensate sales volumes, etc.

The system provides the capability to break the data into units defined by various users. The flexibility available from the custom applications assists field and management personnel in making decisions because the data in the daily reports provides a near real time update of the performance of the production, gathering, processing and delivery of natural gas. The daily production reports may be delivered electronically 510 (e.g., via e-mail, facsimile, or a similar method) or manually as printed hardcopies 510.

ADVANTAGES OF THE INVENTION

One advantage of the invention is that application of the invention will allow for "management by exception" because most of the operations are automated. Managers, editors, or field technicians need only intervene in the gathering process when problems are identified. The invention also reduces the amount of paperwork and time required to recalibrate electronic flow meters, to perform system balances and compositional analyses, to verify transaction data, and to keep records for future validation.

Advantageously, the invention also allows the natural gas gatherer to check various information (e.g., flow volumes and the energy content of the flow, among other data) related to natural gas production, gathering, processing, and sales in near real time. This reduces the possibility for errors in production, processing, and delivery to storage or customers. The invention also provides for a single database that users involved in all stages of the operation can access. The data in the database is closely monitored and is automatically updated after new information, for example new test data, is entered in to the system and, if applicable, approved by an editor. This reduces errors caused by multiple data entries and the entry of invalid data. Moreover, the system may be configured to automatically re-poll EFM computers and other remote devices to ensure proper downloading of test data, gas sample analysis data, etc. Furthermore, the system may be configured to perform an automatic, periodic batch check of EFM test data against data stored in the database. This provides an additional check against field data entered when any EFM has been serviced and recalibrated.

Additionally, the MARS permits data stored in the SCADA/FDC database to be used by geoscientists and reservoir engineers to evaluate reservoir characteristics and make decisions to optimize reservoir production.

Additionally, the MARS permits data stored in the SCADA/FDC database to be used to model, for example, a hydraulic pipeline. Knowledge of pipeline hydraulics are very important in the design of hydrocarbon production, gathering, processing, and delivery facilities. Accurate, near real-time hydraulic data can provide valuable information concerning the flow of hydrocarbons in pipelines. Thus, data stored in the SCADA/FDC database may be directly accessed by hydraulic pipeline modeling software to provide near real time information about pipeline hydraulics. The data may also be used to manage the flow of hydrocarbons in existing facilities by monitoring pipeline hydraulics and assisting in decisions regarding routing of hydrocarbon products from production to delivery.

Those skilled in the art will appreciate that other embodiments of the invention can be devised which do not depart from the spirit of the invention as disclosed herein. Accordingly, the scope of the invention should be limited only by the attached claims.

What is claimed is:

1. A method for automated management of hydrocarbon gathering, the method comprising:

collecting data from a plurality of automated measurement and control devices positioned in a hydrocarbon gathering system;

comparing the collected data with data stored in a database; and using the data comparison to automatically schedule a test of at least one of the plurality of automated measurement and control devices.

2. The method of claim 1, wherein the data stored in the database is automatically updated with the collected data.

3. The method of claim 1, wherein the stored data comprises contractual provisions contained in contracts between a hydrocarbon gathering company and another entity.

4. The method of claim 3, wherein the contractual provisions comprise a testing frequency for the automated measurement and control devices.

5. The method of claim 1, wherein the collected data comprises test scheduling data defined by a hydrocarbon gathering company.

6. The method of claim 1, wherein the plurality of measurement and control devices comprises electronic flow meters.

7. The method of claim 1, wherein the plurality of automated measurement and control devices comprises programmable logic controllers.

8. The method of claim 1, wherein the plurality of automated measurement and control devices comprises remote terminal unit.

9. The method of claim 1, wherein the plurality of automated measurement and control devices comprises automated gas composition analysis devices.

10. The method of claim 1, wherein using the data comparison further comprises:

notifying a field technician of a required test for at least one of the plurality of automated measurement and control devices; and automatically notifying a witness of the test after the field technician has selected a test date.

11. The method of claim 1, wherein the collected data and data stored in the database are used to model pipeline hydraulics.

12. The method of claim 1, further comprising:

using the collected data and data stored in the database to automatically generate a report for a selected unit of a hydrocarbon gathering system.

13. The method of claim 1, wherein the collected data and data stored in the database are used to evaluate reservoir production.

14. A method for automated management of hydrocarbon gathering, the method comprising:

collecting data from a plurality of automated measurement and control devices positioned in a hydrocarbon gathering system;

comparing the collected data with data stored in a database;

using the data comparison to automatically schedule a test of at least one of the plurality of automated measurement and control devices;

analyzing the collected data to determine a volume of a flow of hydrocarbons through at least one of the plurality of automated measurement and control devices;

comparing the volume of the hydrocarbon flow to contractual provisions stored in the database; and automatically scheduling meter tests according to the stored contractual provisions.

15. The method of claim 14, further comprising:

automatically updating the database after testing of at least one of the plurality of automated measurement and control devices.

16. The method of claim 14, wherein selected field personnel are automatically notified of the automatically scheduled tests.

17. The method of claim 16, wherein the automatic notification is transmitted electronically.

18. The method of claim 14, wherein a witness is automatically notified of the automatically scheduled tests.

19. The method of claim 18, wherein the automatic notification is transmitted electronically.

20. The method of claim 14, further comprising:

testing at least one of the plurality of automated measurement and control devices;

automatically comparing test data with master testing data stored in the database; and generating an alarm if a variance between the new testing data and the master testing data exceeds a selected threshold.

21. The method of claim 14, further comprising:

automatically measuring electrical current flow in at least one cathodic protection system positioned in the hydrocarbon gathering system; and generating an alarm if the automatically measured electrical current flow exceeds a selected threshold.

22. The method of claim 14, wherein a computer system connected to the database automatically generates an alarm when a selected event is detected.

23. The method of claim 22, wherein the selected event comprises detection of non-conforming test data collected from at least one of the plurality of automated measurement and control devices.

24. The method of claim 22, wherein the selected event comprises detection of a failure of at least one of the plurality of automated measurement and control devices.

25. The method of claim 22, wherein the selected event comprises detection of a system imbalance beyond a selected threshold.

26. The method of claim 22, wherein the selected event comprises detection of a change in natural gas composition beyond a selected threshold.

* * * * *